US007256359B2

(12) United States Patent
Nishida

(10) Patent No.: US 7,256,359 B2
(45) Date of Patent: Aug. 14, 2007

(54) KEY OPERATION DETECTION UNIT OF AN ELECTRONIC KEYBOARD INSTRUMENT

(75) Inventor: Kenichi Nishida, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 11/488,990

(22) Filed: Jul. 18, 2006

(65) Prior Publication Data

US 2007/0017354 A1 Jan. 25, 2007

(30) Foreign Application Priority Data

Jul. 21, 2005 (JP) ..... 2005-211512

(51) Int. Cl.
*H01H 1/14* (2006.01)

(52) U.S. Cl. ..... 200/1 B; 200/5 A; 84/745

(58) Field of Classification Search ..... 200/1 B, 200/5 A, 512–517; 84/719, 720, 743–745, 84/423 R, 430, 433–435
See application file for complete search history.

(56) References Cited

U.S. PATENT DOCUMENTS 4,668,843 A * 5/1987 Watanabe et al. ..... 200/5 A
5,350,890 A * 9/1994 Fairbrother et al. ..... 200/5 A
5,717,176 A * 2/1998 Dahlstrom ..... 200/1 B
5,952,629 A * 9/1999 Yoshinaga et al. ..... 200/5 A
6,051,767 A * 4/2000 Masubuchi ..... 84/423 R
6,303,887 B1 * 10/2001 Ando ..... 200/512
6,407,321 B2 * 6/2002 Tamaki et al. ..... 84/20
6,965,070 B2 * 11/2005 Wenjun ..... 84/744
7,060,883 B2 * 6/2006 Nagaoka et al. ..... 84/745

FOREIGN PATENT DOCUMENTS

JP 04-272626 9/1992

* cited by examiner

*Primary Examiner*—Elvin Enad
*Assistant Examiner*—M. Fishman
(74) *Attorney, Agent, or Firm*—Morrison & Foerster LLP

(57) ABSTRACT

A key operation detection unit of an electronic keyboard instrument that suppresses increase in reaction forces with key depression operation, to improve a key touch feeling. A depression operation of any one of keys of the keyboard instrument is detected by first and second corresponding detectors of the detection unit. The detectors are surrounded by an outer resilient projection and each comprised of an inner resilient projection and a movable portion extending therefrom toward a base plate of the unit. With key depression, the movable portion of the first detector is in contact with the base plate and its inner resilient projection is deformed to generate a reaction force. With further key depression, the inner resilient projection of the second detector brought in contact with the base plate is deformed to generate a reaction force smaller than the reaction force from the first detector.

10 Claims, 4 Drawing Sheets

KEY OPERATION DETECTION UNIT OF AN ELECTRONIC KEYBOARD INSTRUMENT

BACKGROUND OF THE INVENTION

1. Field of the Invention

The present invention relates to a key operation detection unit of an electronic keyboard instrument, which includes a detector that detects a key depression operation while generating a reaction force when the key depression operation is carried out.

2. Description of the Related Art

Conventionally, a key operation detection unit (switch unit) is known, which comprises a detector (switch) that detects a key depression operation and is moved by a moving member with the key depression operation (see for example, Japanese Laid-open Patent Publication (Kokai) No. H04-272626). This key operation detection unit is provided with two detectors each of which includes a fixed contact formed on a base plate and a movable contact formed on a resilient urging member which is driven by a key actuator. Upon key depression operation, the movable and fixed contacts of these two detectors are closed with a time difference. In addition to the resilient urging member, there is provided a resilient member that generates a reaction force when depressed with the key depression operation.

In the key operation detection unit, the resilient urging member of each detector also generates a reaction force upon key depression operation. The generations of reaction forces from the detectors take place with a time difference. The reaction forces from the detectors are added sequentially in the key depression stroke, and hence the load applied to the key increases stepwise.

When influences of the reaction forces from the detectors upon key touch feeling are not adequately considered in the aforementioned key operation detection unit, a large stepwise variation in the key load gives a key touch feeling which is quite different from that of an acoustic piano, resulting in an unnatural, unsatisfactory key touch feeling.

SUMMARY OF THE INVENTION

It is an object of the present invention to provide a key operation detection unit of an electronic keyboard instrument that suppresses increase in reaction forces with key depression operation, especially in a latter stage of key depression stroke, thereby making it possible to improve a key touch feeling.

To attain the above-mentioned object, according to the present invention, there is provided a key operation detection unit of an electronic keyboard instrument having a plurality of keys disposed for pivotal movement, comprising a base plate that is mounted to the electronic keyboard instrument, a mounting portion that is attached to the base plate, a plurality of resilient projections that project from the mounting portion, at least one of the resilient projections corresponding to an associated one of the keys, a plurality of driven portions that are provided at respective one ends of the resilient projections to extend toward the keys, at least one driven portion being depressed when an associated one of the keys is subjected to a depression operation, a plurality of fixed detecting parts that are fixed to the base plate, a plurality of movable detecting parts that are disposed to face respective ones of the fixed detecting parts and are movable toward and away from the base plate, and a plurality of reaction force generators that are provided to correspond to respective ones of the movable detecting parts, each reaction force generator exerting a reaction force to a corresponding one of the driven portions when an associated movable detecting part is brought in contact with the base plate, and each of the fixed detecting parts and a corresponding one of the movable detecting parts facing the fixed detecting part constitute a detector that detects a depression operation of a corresponding one of the keys, at least two detectors are provided for each of the keys, at least two reaction force generators correspond to at least two movable detecting parts of the at least two detectors, and one of the at least two reaction force generators whose corresponding movable detecting part is brought into contact with the base plate at much later timing in a forward stroke of key depression generates a smaller reaction force.

Preferably, a key depression load applied to a key subjected to a key depression operation varies in accordance with a total sum of at least one primary reaction force generated by deformation of at least one resilient projection corresponding to the key subjected to the key depression and at least two additional reaction forces generated by the at least two reaction force generators corresponding to the key subjected to the key depression, and at least generation timings and magnitudes of the peaks of the at least one primary reaction force and the at least two additional reaction forces are adjusted such that the key depression loads respectively observed at timings at each of which a corresponding one of the at least one primary reaction force and the at least two reaction forces reaches the peak are substantially equal in magnitude to one another.

Preferably, the at least one driven portion is depressed by the key subjected to the depression operation.

Preferably, each of the keys is pivoted around a key fulcrum provided in the electronic keyboard instrument.

Preferably, each of the fixed detecting parts includes a fixed contact formed on the base plate, and each of the movable detecting parts has one end on a side close to the base plate and formed with a movable contact.

Preferably, each of the fixed detecting parts includes a photo-coupler disposed on the base plate, and each of the movable detecting parts has one end disposed on a side close to the base plate and formed with a reflective face which reflects light emitted from the photo-coupler and has a contacting portion that can be in contact with the base plate.

Preferably, the at least one resilient projection is an outer resilient projection that surrounds the at least two detectors.

Preferably, the at least one resilient projection includes at least two outer resilient projections each of which surrounds a corresponding one of the at least two detectors.

More preferably, each of the reaction force generator is an inner resilient projection that is formed inside the outer resilient projection.

More preferably, each of the reaction force generator is an inner resilient projection that is formed inside the outer resilient projection.

According to the present invention, increase in reaction forces caused by key depression detection in a latter stage of key depression stroke can be suppressed to improve a key touch feeling.

Further, a key depression load in a middle stage of the key depression stroke can be made uniform, to thereby attain an excellent key touch feeling.

The above and other objects, features, and advantages of the invention will become more apparent from the following detailed description taken in conjunction with the accompanied drawings.

DETAILED DESCRIPTION OF THE PREFERRED EMBODIMENTS

The present invention will now be described in detail below with reference to the drawings showing preferred embodiments thereof.

Figure 1:
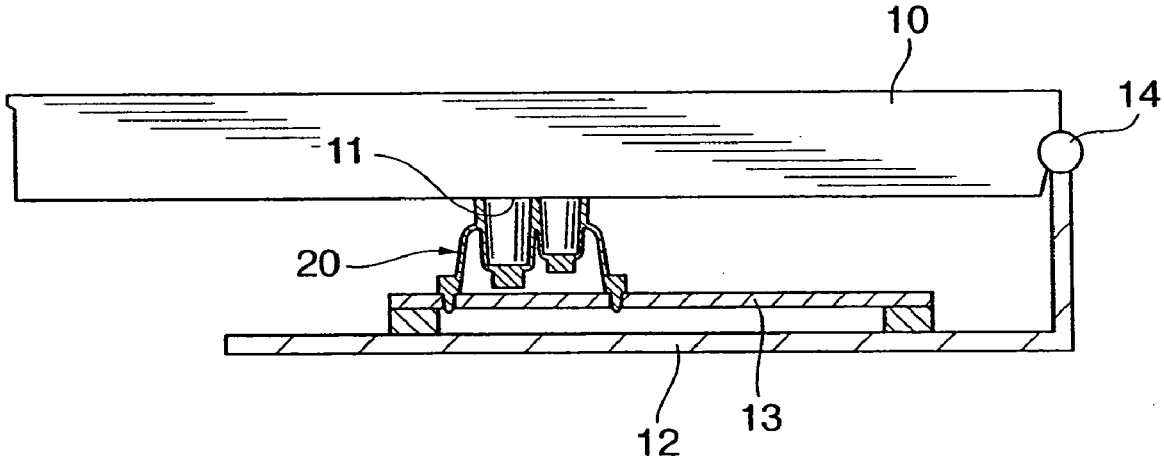
FIG. 1 is a side view showing a keyboard apparatus to which a key operation detection unit according to a first embodiment of the present invention is applied.

FIG. 1 is a side view of a key board apparatus to which a key operation detection unit according to a first embodiment of the present invention is applied.

Referring to FIG. 1, the keyboard apparatus is configured as an electronic musical instrument that is provided with a plurality of keys (only one of which is shown at reference numeral 10 in FIG. 1) each of which is disposed for pivotal motion around a key fulcrum 14 provided in a frame 12. A base plate 13 is fixed to the frame 12. On the base plate 13, key switches (only one of which is shown at reference numeral 20) are provided to correspond to respective ones of the keys 10. Each key 10 has a portion that faces a corresponding one of the key switches 20 and serves as a switch drive portion 11. The key 10 is pivoted around the key fulcrum when depressed, and as a result the switch drive portion 11 thereof depresses the key switch 20.

Although not shown in FIG. 1, the keyboard apparatus is provided with a plurality of pairs of keys and key switches each pair of which is similar in construction to the illustrated pair of the key 10 and the key switch 20. In addition to white keys one of which is illustrated at 10, the keys include black keys, not shown. Except for the key shape and key arrangement, the black keys and the corresponding key switches are the same as the white keys and the key switches concerned.

Figure 2:
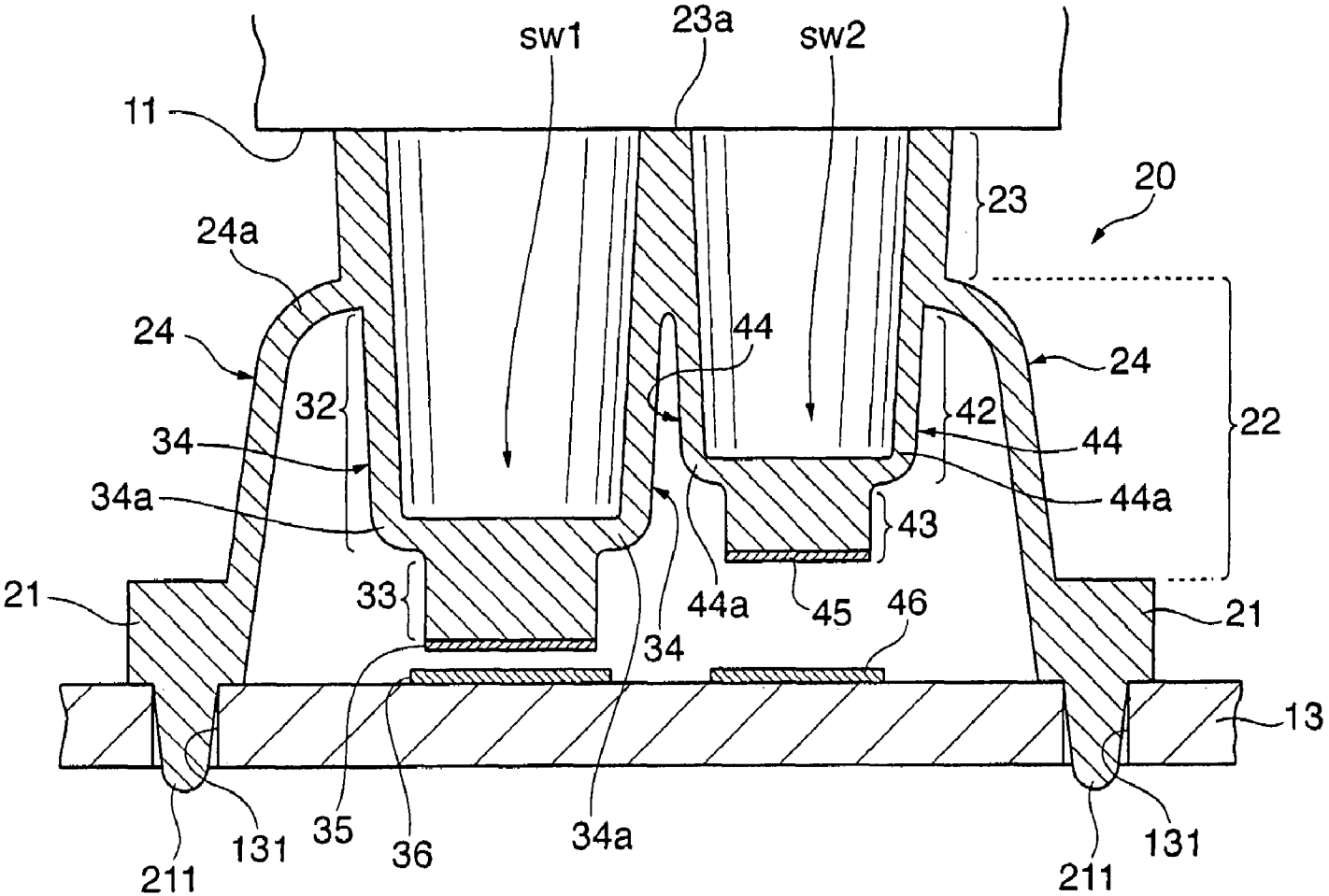
FIG. 2 is a sectional view showing the construction of a key switch shown in FIG. 1.

FIG. 2 is a sectional view showing the construction of the key switch 20. The key switch 20 is a two-make touch-response switch of a contact point-time difference type, which is comprised of a resilient member such as a rubber member.

Referring to FIG. 2, the key switch 20 is provided with a base end 21 from which a plurality of leg portions 211 extend downward. The base plate 13 is formed with through holes 131 corresponding to respective ones of the leg portions 211. These leg portions 211 of the key switch 20 are fitted into the through holes 131, whereby the key switch 20 can be mounted to the base plate 13. An outer resilient projection 22 is formed on the base end 21 of the key switch 20 so as to project upward in a dome shape. The resilient projection 22 is formed by an outer skirt 24 that is easily resiliently deformed. The key switch 20 includes a driven portion 23 that extends upward from an upper end of the outer resilient projection 22. The switch drive portion 11 of the key 10 is in contact with an upper face 23*a* of the driven portion 23 of the key switch 20, and therefore, when the key 10 is depressed, the upper face 23*a* of the driven portion 23 is driven downward by the switch drive portion 23.

Inside the outer resilient projection 22, there are provided first and second inner resilient projections 32 and 42. These projections 32, 42 project downward from that part of the key switch 20 in vicinity of which the driven portion 23 is connected with the outer resilient projection 22. The first and second inner resilient projections 32 and 42 are comprised of first and second inner skirts 34 and 44, respectively, which are easily resiliently deformed. The first inner skirt 34 is formed to be thicker than the second inner skirt 44. A lower portion 34*a* of the first inner skirt 34, which is the thinnest part of the skirt 34, is made thicker than a similar lower portion 44*a* of the second inner skirt 44. The key switch 20 is formed with first and second movable portions 33 and 43 extending downward from respective bottom portions of the first and second inner resilient projections 32 and 42. First and second movable contacts 35 and 45 made of electrically conductive material such as carbon ink are formed on bottom faces of the movable portions 33 and 43.

First and second fixed contacts 36 and 46 constituted by a pair of plate electrodes are formed on the upper face of the base plate 13 to face the first and second movable contacts 35 and 45. The resilient projection 32 is longer than the resilient projection 42. The vertical position of the movable contact 35 is below the vertical position of the movable contact 45. The first inner resilient projection 32, the first movable portion 33 (including the first movable contact 35), and the first fixed contact 36 cooperate one another to form a first detector sw1 that detects that the key 10 has been depressed to reach a first key stroke position. On the other hand, the second inner resilient projection 42, the second movable portion 43 (including the second movable contact 45), and the second fixed contact 46 cooperate one another to form a second detector sw2 that detects that the key 10 has been depressed to reach a second key stroke position that is deeper than the first key stroke position.

With the key switch 20 constructed as above, when the driven portion 23 of the key switch 20 is driven downward by the switch drive portion 11 of the key 10, the outer skirt 24 of the key switch 20 starts to be resiliently deformed (buckled). Thus, the first and second movable portions 33 and 43 are moved downward in unison with the driven portion 23. First, in the first detector sw1, the movable contact 35 is brought in contact with the fixed contact 36. Subsequently, in the second detector sw2, the movable contact 45 is brought in contact with the fixed contact 46. One of the movable and fixed contacts is connected to a voltage source, not shown, and another contact is connected to a detection circuit, not shown. The detection circuit sequentially generates detection signals in response to electrical conduction through the successively closed contacts of the first and second detectors sw1 and sw2. Based on the detection signals, the depression operation of the key 10 including the key-depression velocity is detected, and musical tone generation processing is carried out by a musical tone processor, not shown.

When the first movable contact 35 is in contact with the first fixed contact 36, the first inner skirt 34 starts to be resiliently deformed. Similarly, when the second movable contact 45 is in contact with the second fixed contact 46, the second inner skirt 44 starts to be resiliently deformed. When being resiliently deformed, the outer skirt 24 generates a reaction force. Similarly, the first and second inner skirts 34 and 44 also generate reaction forces while being resiliently deformed. These reaction forces are applied through the driven portion 23 to the key 10 in a direction opposite the direction in which a key depression load is applied by the player to the key 10. In other words, the reaction forces represent the required key depression load (hereinafter referred to as "the key depression load"). In the present embodiment, these reaction forces are adjusted in advance to appropriate values, as will be explained below.

Figure 3:
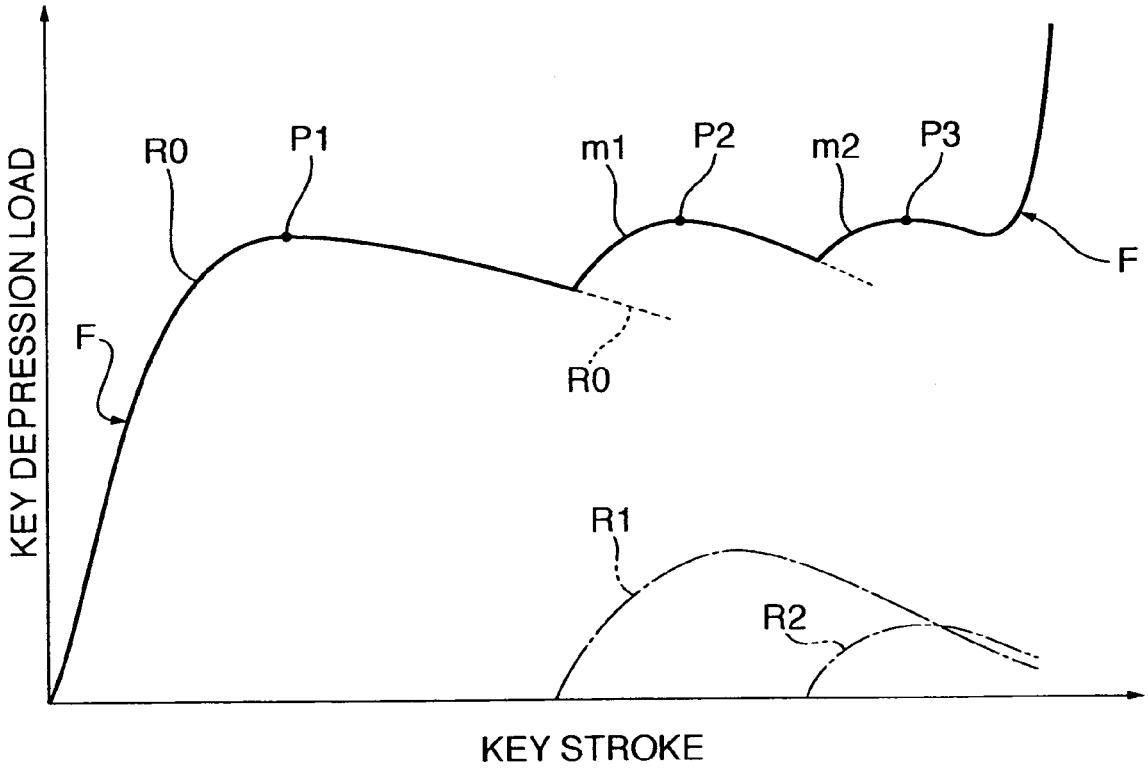
FIG. 3 is a view showing a relationship between key stroke and key depression load in the forward stroke of a key depression.

FIG. 3 shows a relationship between key stroke and key depression load in the forward stroke of a key depression. Referring to FIG. 3, a primary reaction force R0 represents the above-mentioned reaction force generated by resilient deformation of the outer skirt 24, and varies with the increase in key stroke. Specifically, the primary reaction force R0 abruptly increases to its peak with the increasing key stroke and then gradually decreases with further increase in the key stroke. First and second additional reaction forces R1 and R2 represent the aforementioned reaction forces that are generated by resilient deformation of the first and second inner skirts 34 and 44. Each of the first and second additional reaction forces R1, R2 increases to its peak with the increasing key stroke in a middle or final stage of the key depression stroke, and then decreases with further increase in the key stroke. Vertical positions of the movable contacts 35, 45 in the key switch 20 and other factors are preset in such a manner that the first and second additional reaction forces R1 and R2 are generated in a latter stage of the forward stroke of a key depression. Each of the reaction forces R0, R1, and R2 decreases once its peak has been reached. It is considered that buckling-like phenomena can occur in the cup-shaped skirts made of rubber material and can cause the decrease in the reaction forces after their peaks have been reached.

The key depression load F varies according to the total sum of the primary reaction force R0 and the first and second additional reaction forces R1 and R2. Specifically, in an initial stage of a key depression, the key depression load F varies solely according to the primary reaction force R0 that increases to its peak with the increasing key stroke, and then decreases. When the first movable contact 35 is in contact with the first fixed contact 36, the outer skirt 34 starts to be elastically deformed, and the summation of the primary reaction force R0 and the first additional reaction force R1 determines the key depression load F. Therefore, the key depression force F increases again, as shown by a crest portion m1 of the load F in FIG. 3. In timing at which the first additional reaction force R1 reaches its peak value in a later half of the forward stroke of the key depression, the key depression load F reaches a peak P2, and then decreases with the increasing key stroke.

Similarly, when the second movable contact 45 is in contact with the second fixed contact 46 and the second inner skirt 44 starts to elastically be deformed, the second additional reaction force R2 is added to the sum of the primary reaction force R0 and the first additional reaction force R1. Thus, the key depression load F determined by the summation of these three reaction forces increases again with the increasing key stroke, as shown by a crest portion m2 in FIG. 3. In timing at which the second additional reaction force R2 reaches its peak immediately before the end of the key depression which lags behind the peak P2, the key depression load F reaches a peak P3, and thereafter temporarily decreases. Finally, the key 10 is in contact with a key depression stopper, not shown, and the key depression load F abruptly increases, whereupon the forward stroke of the key depression ends.

The magnitudes of the reaction force R0 and the first and second reaction forces R1 and R2 and generation timings thereof are preset such that the peaks P1, P2, and P3 of the key depression load F are substantially the same in level. As a result, the key depression load F remains substantially constant from the initial rising region to the final region in which the key depression load F abruptly increases although the crest portions m1 and m2 are observed. This suppresses occurrences of an unnatural feeling caused, for example, by the key depression load F that increases stepwise in a latter half of the forward stroke of a key depression, thus realizing a satisfactory key touch feeling.

Such reaction force adjustment can be achieved mainly by properly presetting the thicknesses and the radii of roundness of the upper portion 24*a* of the outer skirt 24, the lower portions 34*a* and 44*a* of the first and second inner skirts 34 and 44, which are the thinnest portions of the skirts (see, FIG. 2). For example, when the upper and lower portions 24*a*, 34*a*, and 44*a* are made thinner or when the radii of roundness are made larger, the skirts are easy to buckle and the reaction forces from the skirts decrease accordingly. The generation timings of the reaction forces can also be adjusted by the settings of the shapes of the upper and lower portions 24*a*, 34*a*, and 44*a* of the skirts as well as the distances between the first and second movable contacts 35, 45 and the first and second fixed contacts 36, 46, and so on.

According to the present embodiment, the reaction force generated by the second signal detector sw2 whose contacts are closed after the closure of the contacts of the first detector sw1 is made smaller than the reaction force generated by the first detector sw1. This makes it possible to suppress the increase in reaction force caused by the detection of key depression in a later half of the key depression stroke, resulting in an improved key touch feeling.

Furthermore, the first detector sw1 whose contacts are closed earlier is longer in length from the root of the first inner resilient projection 32 to the tip end of the first movable portion 33, as compared to the second signal detector sw2. In general, therefore, the first inner resilient projection 32 of the first detector sw1 can unequally be deformed when the contacts thereof are closed. This can produce a drawback that the first movable portion 33 is likely to be laterally tilted (buckled). In this regard, the first inner skirt 34 of the present embodiment is made thicker than the second inner skirt 44, and thus the first inner skirt 34 generates a reaction force larger than that generated from the second inner skirt 44 (see FIG. 2). This advantageously suppresses the first movable portion 33 from being inclined.

Furthermore, at least generation timings and magnitudes of the peaks of the primary reaction force R0 and the first and second additional reaction forces R1, R2 are adjusted such that the key depression load F remains a substantially constant level from the initial rising region to the final abruptly increasing region, in consideration of a combined effect of generation, increase, and decrease of the primary reaction force R0 and the first and second additional reaction forces R1 and R2. As a result, a change in the key depression load with the increasing key stroke especially in a middle stage of a key depression stroke can be reduced, thus realizing a satisfactory key touch feeling.

In the following, a second embodiment of the present invention will be explained.

In the first embodiment, a case where the first and second detectors sw1 and sw2 are each constituted by a contact switch. On the other hand, each detector in the second embodiment is constituted by a non-contact switch.

Figure 4B:
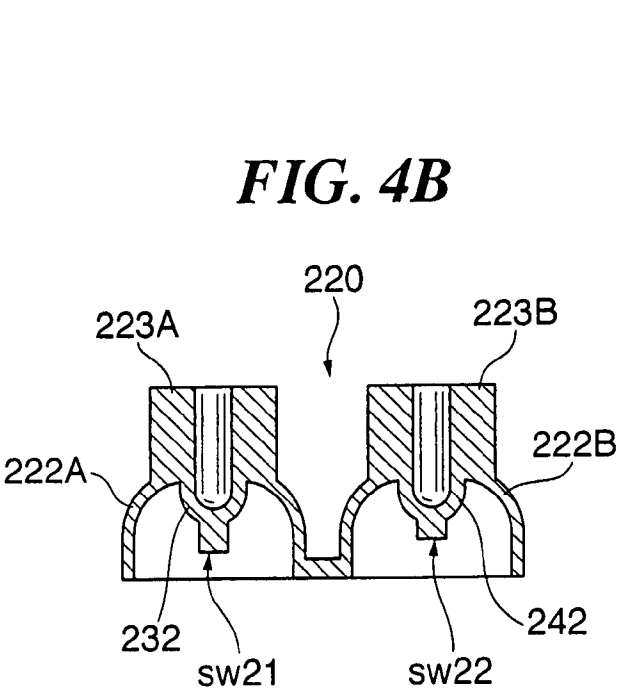
FIG. 4B is a sectional view showing a modification of a key switch in which two outer resilient projections are provided independently of each other.
Figure 4A:
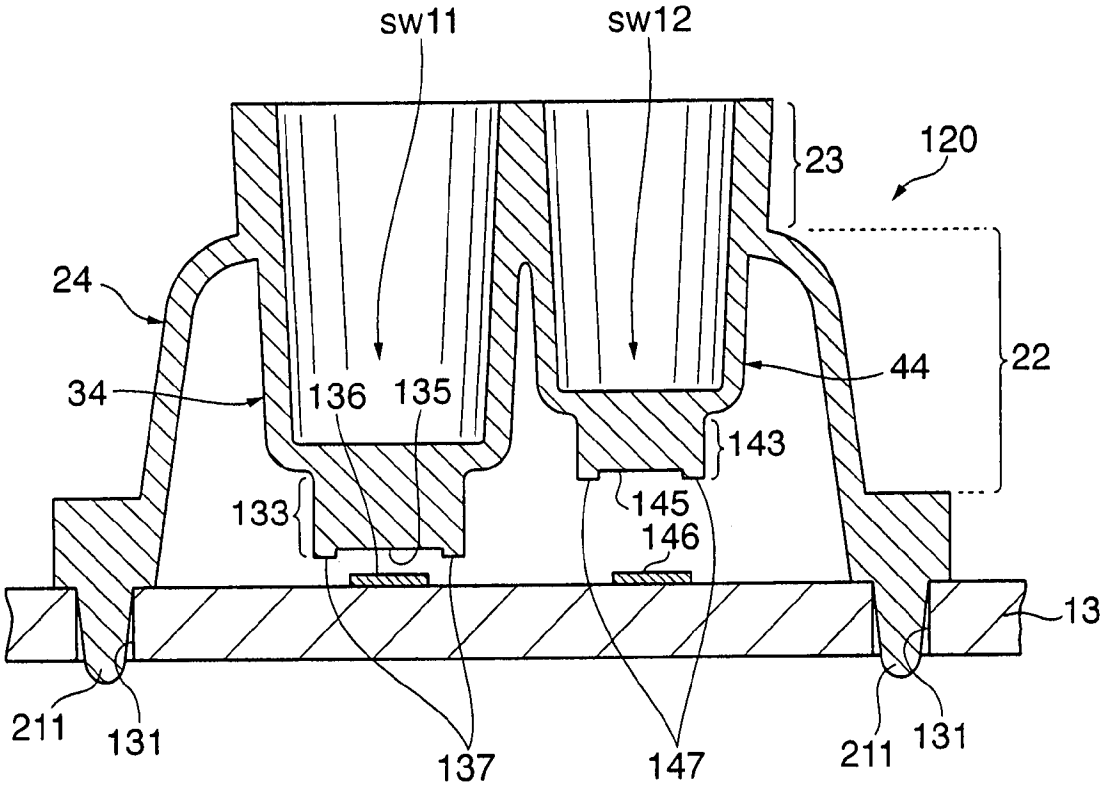
FIG. 4A is a sectional view showing the construction of a key switch of a keyboard apparatus to which a key operation detection unit according to a second embodiment of the present invention is applied.

FIG. 4A is a sectional view showing the construction of a key switch of a keyboard apparatus to which a key operation detection unit according to the second embodiment is applied. The key switch 120 of the present embodiment differs from that of the first embodiment in that first and second detectors sw11 and sw12 are provided in place of the first and second detector sw1 and sw2 of the first embodiment. Furthermore, the key switch 120 is provided with first and second movable portions 133 and 134 which are alternative to the first and second movable portions 33 and 34 of the key switch 20, and is also provided with first and second photo-couplers 136 and 146 which are alternative to the first and second fixed contacts 36 and 46. The other constructions of the keyboard apparatus including the remaining structure of the key switch are the same as those of the first embodiment, and hence explanations thereof will be omitted.

As shown in FIG. 4A, the photo-couplers 136 and 146 are disposed on the base plate 13. Although illustrations are omitted, each of the photo-couplers 136 and 146 includes a pair of a light emitting element and a light receiving element. The light emitting element always emits light upward. First and second movable portions 133 and 143 of the first and second detectors sw11 and sw12 are formed at lower ends thereof with contacting portions 137 and 147 whose outer peripheries protrude downward. Within the outer peripheries of the contacting portions 137 and 147, there are formed relatively flat concave faces 135 and 145 onto which white-colored paint that is easy to reflect light is applied.

With a key depression operation, the first and second movable portions 133 and 143 are moved downward. The first contacting portion 137 is first brought in contact with the base plate 13, and then the second contacting portion 147 is in contact therewith. Upon sequential contacts of the contacting portions with the base plate, reaction forces are sequentially generated from the first and second inner skirts 34 and 44 of the first and second detectors sw11 and sw12 in the same manner as in the first embodiment.

Light emitted from each of the light emitting elements of the first and second photo-couplers 136 and 146 is reflected by the concave face 135 or 145 and then received by the light receiving element of a corresponding one of the photo-couplers. When the first or second contacting portion 137 or 147 is in contact with the base plate 13, an amount of light received by the corresponding one of the light receiving elements abruptly increases, so that electric current flowing through the photo-coupler exceeds a threshold value, whereby a key depression operation is detected.

The present embodiment can provide effects similar to those achieved by the first embodiment.

It should be noted that the detector is not limited to the aforementioned detectors sw1, sw2, sw1, and sw12, but may be comprised of fixed and movable detecting parts disposed to face each other, wherein a key depression operation is detected based on a movement of the movable detecting part toward the fixed detecting part. The detector may be either a contact type or a non-contact type. For example, an electrostatic capacitance sensor may be mounted on the base plate 13 and a movable part having a bottom end provided with an electrical conductive component may be disposed to face the sensor, to detect a key depression operation based on a change in the sensor output voltage that varies according to a distance between the movable detecting part and the sensor.

Although the arrangement where the first and second detectors are disposed inside the common outer resilient projection 22 has been described by way of example in the second embodiment, this is not limitative.

FIG. 4B is a sectional view showing a modification of the key switch having two outer resilient projections which are independent of each other. The key switch 220 is provided with two outer resilient projections which are independent of each other and which correspond as a whole to the outer resilient projection 22 shown in FIG. 4A.

In the key switch 220, first and second driven portions 223A and 223B are formed on upper ends of the first and second outer resilient projections 222A and 222B which are independent of each other. With a key depression operation of a key corresponding to the driven portions 223A and 223B, both the driven portions 223A and 223B are urged downward by the key in FIG. 4B. First and second detectors sw21 and sw22 are formed inside respective ones of the first and second outer resilient projections 222A and 222B, and are provided with first and second inner resilient projections 232 and 242 similar to the first and second inner resilient projections 32 and 42 shown in FIG. 2. The first and second detectors sw21 and sw22 are designed to be brought into an electrically conductive state in succession in response to a key depression operation, while generating reaction forces. A time difference between when the first detector is brought to a conductive state and when the second detector is brought to a conductive state and a reaction force difference in the first and second detectors are preset as in the first and second detectors sw1 and sw2 of the key switch 20 shown in FIG. 2.

It should be noted that the case where each key switch is driven directly by the corresponding key has been described in the aforementioned embodiments, but this is not limitative. The present invention is also applicable to an arrangement where the key switch is driven by a movable member that makes a pivotal movement or other movement in response to a key depression operation, such as a mass member that is pivoted in unison with the associated key that is being depressed, and applicable to an arrangement where the key switch is driven by any member that is interposed between the key and the movable member. The member used to drive the key switch may make a translational movement other than a pivotal movement.

It should be noted that the arrangement where two detectors are provided for each individual key switch has been described in the embodiments, but this is not limitative. For example, three or more detectors may be provided for each individual key switch. In this case, the three or more detectors may be configured such that that one of these detectors whose corresponding movable part is brought into contact with the base plate or the fixed contact at much later timing in the key depression stroke generates a smaller reaction force.

While there has been described that the reaction force generation in each individual detector results mainly from resilient deformation of the first and second inner skirts 34 and 44, the way of reaction force generation is not limited thereto. The reaction force generator may have any construction so long as a reaction force can be generated when the movable part is brought in contact with the base plate or the fixed contact. Such reaction force generator can be constructed based on the aforementioned technical concept.

What is claimed is:

1. A key operation detection unit of an electronic keyboard instrument having a plurality of keys disposed for pivotal movement, comprising:

a base plate that is mounted to the electronic keyboard instrument;

a mounting portion that is attached to said base plate;

a plurality of resilient projections that project from said mounting portion, at least one of the resilient projections corresponding to an associated one of the keys;

a plurality of driven portions that are provided at respective one ends of said resilient projections to extend toward the keys, at least one driven portion being depressed when an associated one of the keys is subjected to a depression operation;

a plurality of fixed detecting parts that are fixed to said base plate;

a plurality of movable detecting parts that are disposed to face respective ones of the fixed detecting parts and are movable toward and away from said base plate; and a plurality of reaction force generators that are provided to correspond to respective ones of the movable detecting parts, each reaction force generator exerting a reaction force to a corresponding one of the driven portions when an associated movable detecting part is brought in contact with said base plate, wherein:

each of said fixed detecting parts and a corresponding one of the movable detecting parts facing the fixed detecting part constitute a detector that detects a depression operation of a corresponding one of the keys, at least two detectors are provided for each of the keys, at least two reaction force generators correspond to at least two movable detecting parts of the at least two detectors, and that one of said at least two reaction force generators whose corresponding movable detecting part is brought into contact with said base plate at much later timing in a forward stroke of key depression generates a smaller reaction force.

2. A key operation detection unit of an electronic keyboard instrument according to claim 1, wherein:

a key depression load applied to a key subjected to a key depression operation varies in accordance with a total sum of at least one primary reaction force generated by deformation of at least one resilient projection corresponding to the key subjected to the key depression and at least two additional reaction forces generated by the at least two reaction force generators corresponding to the key subjected to the key depression, and at least generation timings and magnitudes of the peaks of the at least one primary reaction force and the at least two additional reaction forces are adjusted such that the key depression loads respectively observed at timings at each of which a corresponding one of the at least one primary reaction force and the at least two reaction forces reaches the peak are substantially equal in magnitude to one another.

3. A key operation detection unit of an electronic keyboard instrument according to claim 1, wherein said at least one driven portion is depressed by the key subjected to the depression operation.

4. A key operation detection unit of an electronic keyboard instrument according to claim 1, wherein each of the keys is pivoted around a key fulcrum provided in the electronic keyboard instrument.

5. A key operation detection unit of an electronic keyboard instrument according to claim 1, wherein each of said fixed detecting parts includes a fixed contact formed on said base plate, and each of said movable detecting parts has one end disposed on a side close to said base plate and formed with a movable contact.

6. A key operation detection unit of an electronic keyboard instrument according to claim 1, wherein each of said fixed detecting parts includes a photo-coupler disposed on said base plate, and each of said movable detecting parts has one end on a side close to said base plate and formed with a reflective face which reflects light emitted from the photo-coupler and has a contacting portion that can be in contact with said base plate.

7. A key operation detection unit of an electronic keyboard instrument according to claim 1, wherein said at least one resilient projection is an outer resilient projection that surrounds said at least two detectors.

8. A key operation detection unit of an electronic keyboard instrument according to claim 1, wherein said at least one resilient projection includes at least two outer resilient projections each of which surrounds a corresponding one of said at least two detectors.

9. A key operation detection unit of an electronic keyboard instrument according to claim 7, wherein each of said reaction force generator is an inner resilient projection that is formed inside said outer resilient projection.

10. A key operation detection unit of an electronic keyboard instrument according to claim 8, wherein each of said reaction force generator is an inner resilient projection that is formed inside said outer resilient projection.

* * * * *